US008292082B2

(12) United States Patent
Bowman

(10) Patent No.: US 8,292,082 B2
(45) Date of Patent: Oct. 23, 2012

(54) PRODUCT DISPLAY CARTON

(75) Inventor: Linden H. Bowman, Marlboro, NJ (US)

(73) Assignee: The Lindy Bowman Company, Elkridge, MD (US)

( * ) Notice: Subject to any disclaimer, the term of this patent is extended or adjusted under 35 U.S.C. 154(b) by 0 days.

(21) Appl. No.: 13/439,907

(22) Filed: Apr. 5, 2012

(65) Prior Publication Data

US 2012/0187025 A1 Jul. 26, 2012

Related U.S. Application Data

(63) Continuation-in-part of application No. 12/468,259, filed on May 19, 2009, now abandoned, which is a continuation-in-part of application No. 11/766,553, filed on Jun. 21, 2007, now abandoned.

(51) Int. Cl.
*B65D 5/50* (2006.01)

(52) U.S. Cl. ..... 206/764; 206/756

(58) Field of Classification Search ..... 206/587, 206/586, 589, 592, 564, 454, 756; 220/528, 220/529

See application file for complete search history.

(56) References Cited

U.S. PATENT DOCUMENTS 2,260,428 A 10/1941 Barr et al.
3,807,622 A 4/1974 Belcher et al.
3,927,761 A * 12/1975 Boyle ..... 206/756
3,955,671 A 5/1976 Ockey
3,990,624 A 11/1976 Melli
4,607,750 A 8/1986 Valenti
5,372,299 A 12/1994 Edgerton et al.
5,487,504 A 1/1996 Baird
5,505,309 A * 4/1996 Taravella et al. ..... 206/485
5,505,371 A 4/1996 O'Neil
5,913,426 A * 6/1999 Lotz Renfro et al. ..... 206/763
5,950,911 A 9/1999 Naughton et al.
6,676,012 B1 * 1/2004 Southwell et al. ..... 229/120.17
6,953,118 B2 10/2005 Seno et al.
7,000,773 B2 2/2006 Hubbs et al.
7,152,740 B1 12/2006 Chang
7,320,407 B2 1/2008 Hubbs et al.

* cited by examiner

*Primary Examiner* — Andrew Perreault
(74) *Attorney, Agent, or Firm* — Cahn & Samuels, LLP

(57) ABSTRACT

A display carton includes a display box having an open top. The display box includes a bottom panel; a rear wall extending upwardly from the bottom panel; a pair of side walls extending upwardly from the bottom panel; and a pair of front walls, each front wall extending inwardly from a side wall and attached to a bottom front wall extending upwardly from the bottom panel. The pair of front walls and the bottom front wall form a substantially unobstructed center viewing area for a product displayed in the display carton. The display carton also includes a single removable insert. The insert includes a foldable sheet having at least one set of dividers extending inwardly from the side walls and upwardly from the bottom panel, thereby defining at least two product receiving compartments for supporting a product.

17 Claims, 10 Drawing Sheets

PRODUCT DISPLAY CARTON

RELATED APPLICATIONS

This application is a Continuation-In-Part application of U.S. Ser. No. 12/468,259, filed on May 19, 2009, which is a Continuation-In-Part application of U.S. Ser. No. 11/766,553, filed in the U.S. Patent and Trademark Office on Jun. 21, 2007, the entireties of which are incorporated herein by reference.

FIELD OF THE INVENTION

The present invention is directed to a product display carton including a display box and a single removable insert forming product receiving compartments.

BACKGROUND OF THE INVENTION

U.S. Pat. No. 7,000,773 B2 discloses a product display and support carton that includes a display box and an opposed pair of dividers. The display box is defined by a bottom panel and an upwardly extending wall panel which together form a product carrying enclosure. The product carrying enclosure defined by the bottom panel and wall panel is inclined at an angle to the vertical when the bottom panel is on a horizontal surface. With this arrangement, an opposed pair of dividers extends upwardly from opposite sides of the wall panel into the product carrying enclosure toward one another to define at least two separate product receiving compartments. This patent requires a plurality of separate carton inserts, none of which has a portion extending across the bottom panel of the display box.

U.S. Pat. No. 5,505,371 discloses a shipping and display carton that includes an outer container and an inner partition structure. The partition structure is constructed from a single cut and scored blank of corrugated paperboard that is folded and erected to form a modified Z-type divider with three loading cells. The front wall of the outer container includes a perforated cut-out that is removed for display purposes, and each divider panel of the partition structure includes a cut-out that is compatible in size and shape with the cut-out in the front wall of the outer container. However, the partitions structure or blank of this patent requires cut-outs, fold lines, and double score lines.

U.S. Pat. No. 3,955,671 discloses a carton for shipping and displaying a plurality of food packets or the like includes a generally rectangular, open-top member adapted to receive a plurality of food packets for packing and shipping, and a truncated member adapted to close telescopically over the rectangular member. The side walls are provided with serrated flaps which are joined to the side walls by score lines to retain the food packets disposed within the truncated carton member.

Known cartons are difficult to set up for display. In addition, the partition elements are cumbersome to set-up, insert, and remove. Accordingly, there is a need for a display carton that is more user-friendly without sacrificing strength.

SUMMARY OF THE INVENTION

It is an object of the present invention is to provide a cost-effective display carton which is easy to set-up.

Still another object of the present invention is to provide a display carton with a single, unitary removable insert.

It is a further object of the present invention to provide a secure compartment for a product while also allowing for a substantially unobstructed view of the product in the display carton.

An advantage of the present invention is that the bottom and sides of a product may be supported by the single, unitary removable insert.

The above objects and advantages are satisfied by a display carton comprising a display box and a single removable insert. The display box has an open top and comprises a bottom panel; a rear wall extending upwardly from the bottom panel; a pair of side walls extending upwardly from the bottom panel; and a pair of front walls, each front wall extending inwardly from a side wall and attached to a bottom front wall extending upwardly from the bottom panel. The pair of front walls and the bottom front wall form a substantially unobstructed center viewing area for a displayed product. The single removable insert comprises at least one set of dividers extending inwardly from the side walls, upwardly from the bottom panel, and parallel to the rear wall, thereby defining at least two product receiving compartments for supporting product.

In at least one embodiment, the single removable insert comprises a foldable sheet having three sections, each section comprising at least one rib having at least one angled end. The ribs are configured so that when the foldable sheet is folded into a U-shaped insert, the ribs form at least one set of dividers. The at least one set of dividers comprises a first rib positioned against a first side wall adjacent to a second rib extending across the bottom panel of the display box which is adjacent to a third rib positioned against a second side wall opposite said first side wall, thereby defining at least two product receiving compartments.

In at least one embodiment, the single removable insert comprises a foldable sheet having three sections. The sheet comprises a rib on a first section having an end at a right angle to a horizontal surface of the foldable sheet; a rib on a second section having two ends, each end at an acute angle to a horizontal surface of the foldable sheet; and a rib on a third section having an end at a right angle to a horizontal surface of the foldable sheet. The ribs are configured so that when the foldable sheet is folded into a U-shaped insert, the ribs form at least one set of dividers. The at least one set of dividers comprises a first rib positioned against a first side wall adjacent to a second rib extending across the bottom panel of the display box which is adjacent to a third rib positioned against a second side wall opposite said first side wall, thereby defining at least two product receiving compartments.

In one or more embodiments, the single insert may comprise a foldable sheet having three sections, each section comprising at least one hinged flap. The at least one hinged flap on each end section comprises a rectangular-shaped section and a footer, and the at least one hinged flap on a middle section comprises a trapezoid-shaped section.

As used herein "substantially", "generally", "relatively", and "about" are relative modifiers intended to indicate permissible variation from the characteristic so modified. It is not intended to be limited to the absolute value or characteristic which it modifies but rather approaching or approximating such a physical or functional characteristic.

References to "one embodiment", "an embodiment", or "in embodiments" mean that the feature being referred to is included in at least one embodiment of the invention. Moreover, separate references to "one embodiment", "an embodiment", or "in embodiments" do not necessarily refer to the same embodiment; however, neither are such embodiments mutually exclusive, unless so stated, and except as will be readily apparent to those skilled in the art. Thus, the invention can include any variety of combinations and/or integrations of the embodiments described herein.

In the following description, reference is made to the accompanying drawings, which are shown by way of illustration to specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

DETAILED DESCRIPTION OF THE INVENTION

FIGS. 1-19 illustrate a product display carton including a display box and a single removable insert forming product receiving compartments. The display carton displays and supports at least one product, such as gift bags.

Figure 1:
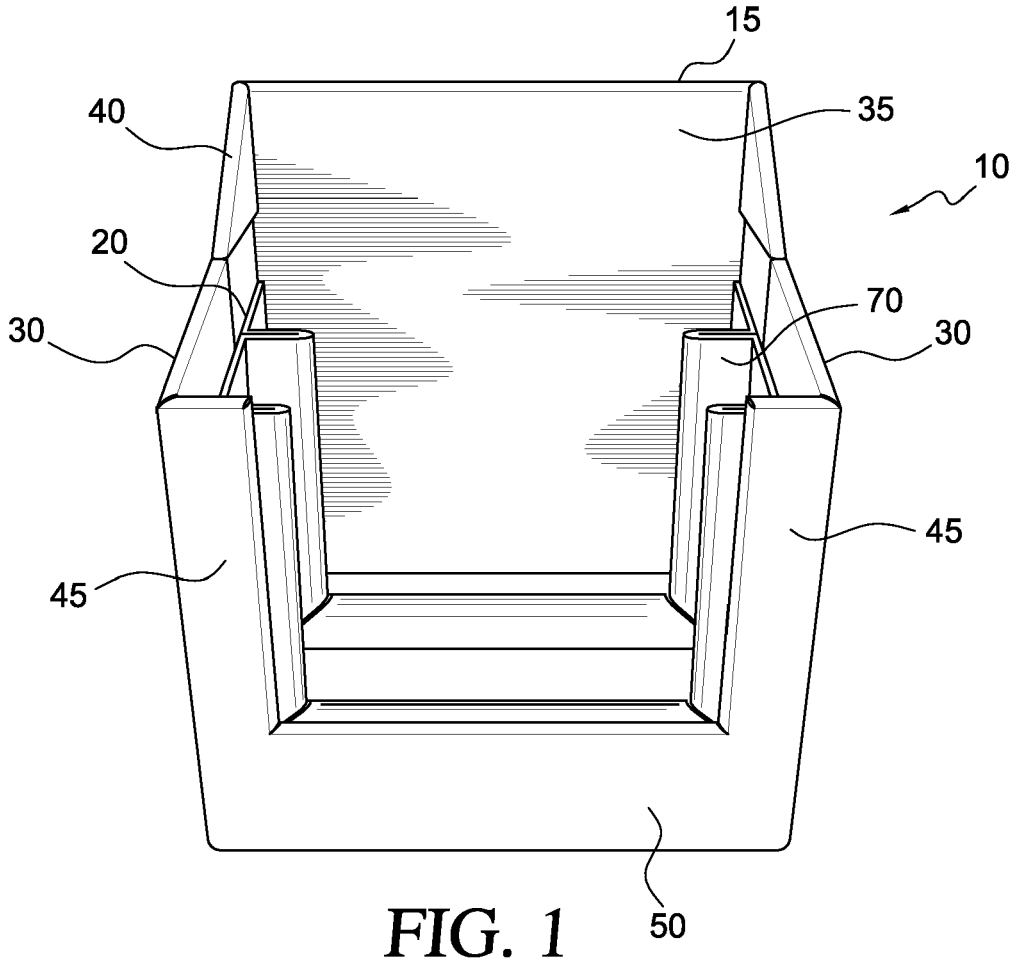
FIG. 1 illustrates a front view of the display carton according to the present invention.

FIG. 1 illustrates a product display carton 10 according to the present invention. The display carton 10 includes a display box 15 having and open top and a single removable insert 20. The display box 15 and insert 20 may be made from any suitable material. Preferably, the display box and the insert are both formed of paper, a cardboard material, or a corrugated cardboard material. In specific embodiments, the display box and the insert comprise no plastic, thermoplastic, or resin material.

As shown in FIGS. 1-4, the display box 15 comprises a bottom panel 25; a pair of side walls 30 extending upwardly from the bottom panel 25; and a rear wall 35 extending upwardly from the bottom panel. Rear wall 35 advantageously comprises a panel of at least the height of the products to be displayed within display box 15. In embodiments, the pair of side walls 30 may each have a rear portion 40 that extends at an angle upwardly to a top edge of the rear wall 35.

The display box 15 comprises has a pair of front walls 45, each front wall extending inwardly from a respective side wall 30, so as to provide product retaining rails for product to be displayed in display carton 10. For example, the pair of front walls 45 may extend inwardly up to about 3 inches, for example, about 1 inch from the side walls 30. The pair of front walls 45 is attached to and contiguous with a bottom front wall 50 that extends upwardly from the bottom panel of the display box 15 for up to about 6 inches, for example, up to about 2 or 3 inches. Like the front walls 45, the bottom front wall 50 comprises a product retaining rail for products to be displayed in display carton 10.

The two front walls 45 and bottom front wall 50 help restrain a product placed into the product display box, help provide structural support for the display box, and also provides space for pictures, words, or other kinds of advertising on the display box. In addition, front walls 45 and bottom front wall 50 form a substantially unobstructed center viewing area for a product displayed in the display carton.

Bottom panel 25, side walls 30, rear wall 35, front walls 45 and bottom front wall 50 together form an enclosure for a single removable insert 20.

Figure 2:
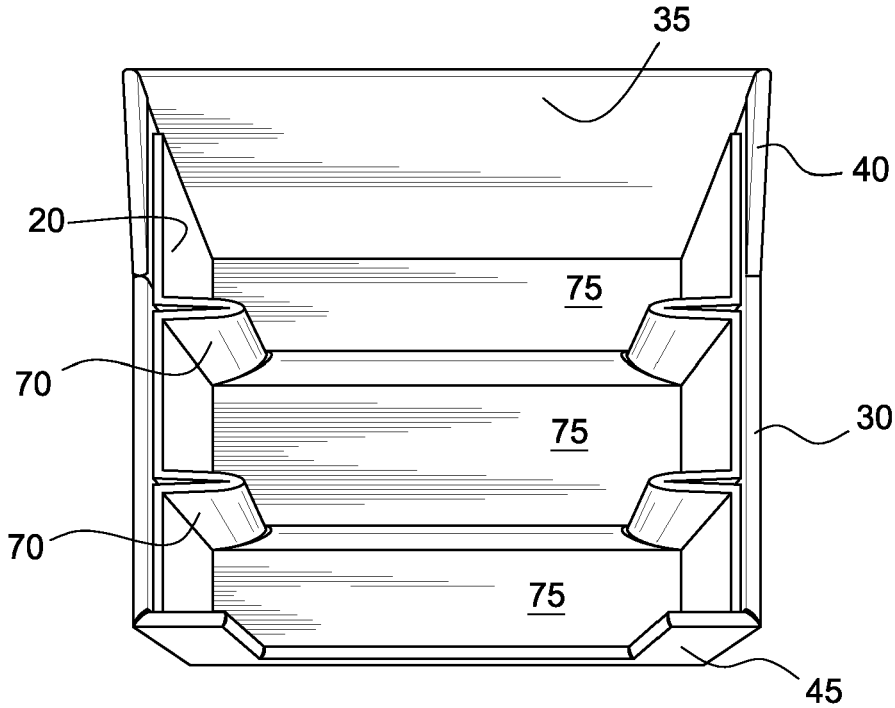
FIG. 2 illustrates a top view of the display carton of FIG. 1.
Figure 3:
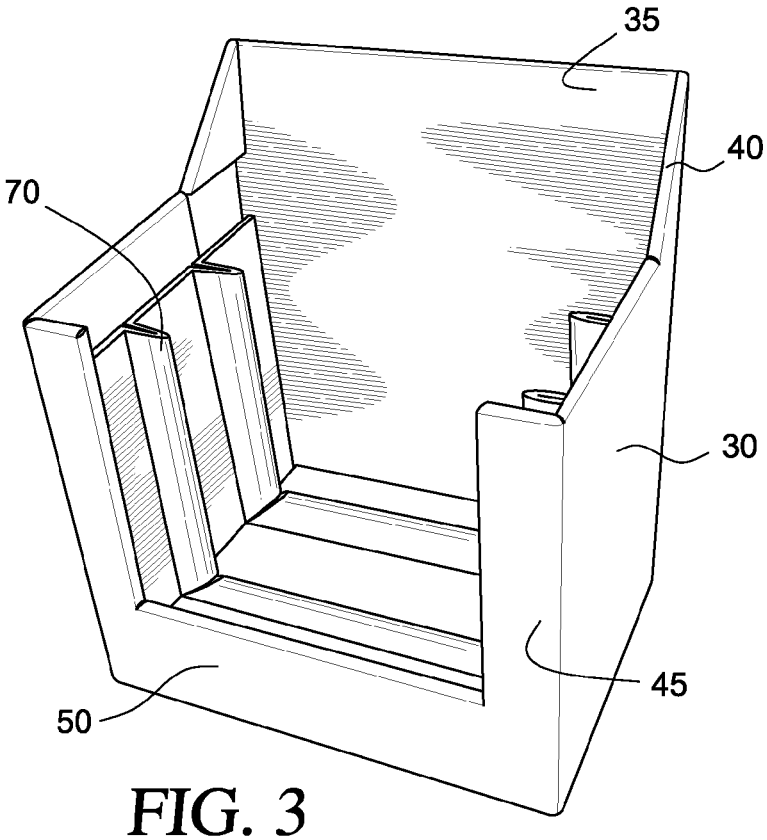
FIG. 3 illustrates a perspective view of the display carton of FIG. 1.
Figure 4:
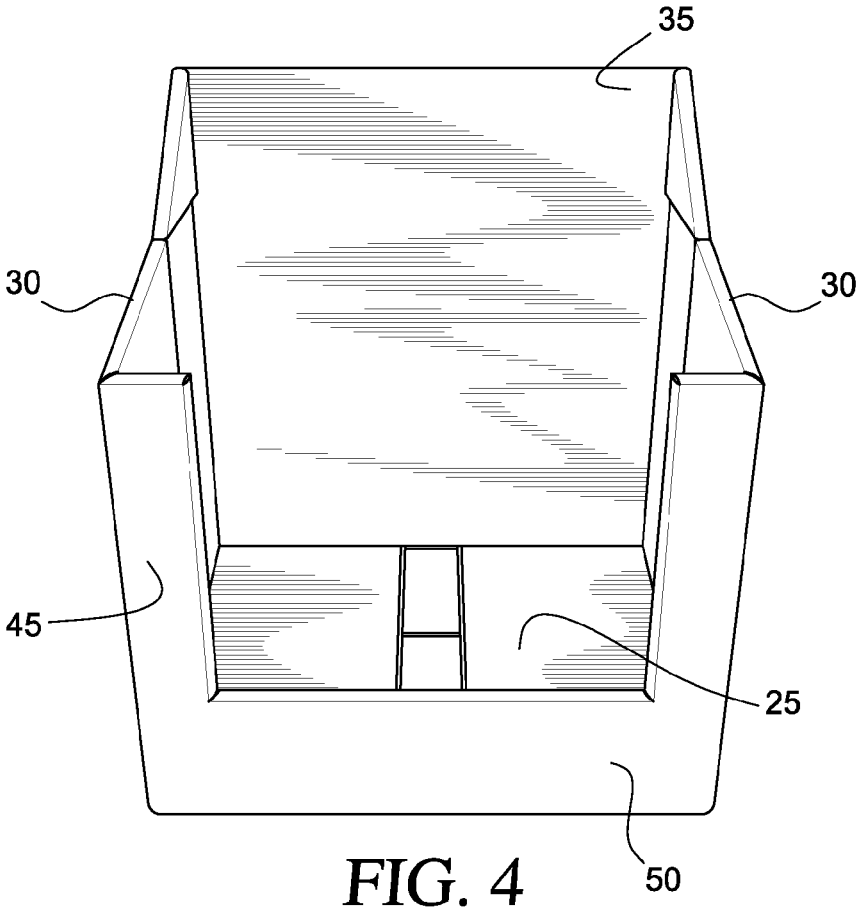
FIG. 4 illustrates a front view of a display box of FIG. 1 without an insert.

As shown in FIGS. 1-3, single removable insert 20 comprises at least one set of dividers 70 extending inwardly from the pair of side walls, upwardly from the bottom panel, and parallel to the rear wall. The at least one set of dividers 70 forms at least two product receiving compartments 75 for supporting product displayed in the display carton.

Figure 5:
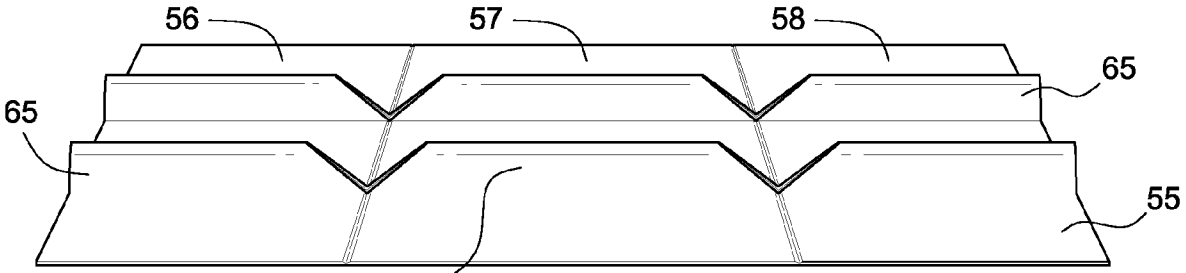
FIG. 5 illustrates a front view of an insert according to the present invention.
Figure 6:
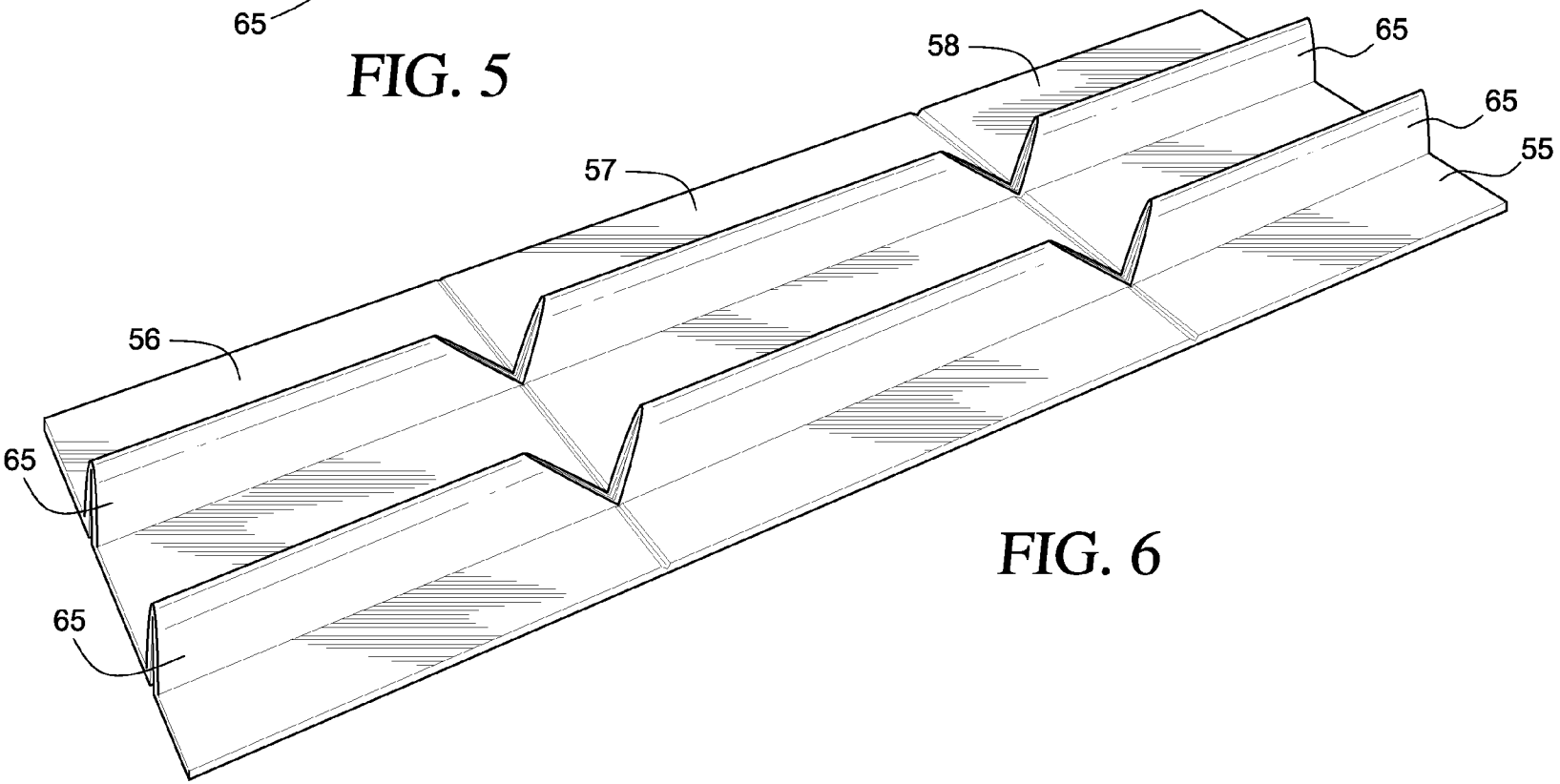
FIG. 6 illustrates a perspective view of the insert of FIG. 5.

As shown in FIGS. 5-6, single removable insert 20 comprises a foldable sheet 55 comprising three sections 56, 57, 58, each section having at least one rib 65. In embodiments, each of sections 56, 57, 58 may have two ribs 65. The at least one rib of each section has at least one angled end, for example, an end having an angle of about 45° from a horizontal surface of the foldable sheet 55. Thus, when the foldable sheet 55 is folded into a U-shaped insert, the at least one angled end of a rib on one section lies proximate to the at least one angled end of a rib on an adjacent section, thereby forming a 90° angle.

When the foldable sheet 55 is folded into a U-shaped insert, the ribs 65 form at least one set of dividers 70 that defines product receiving compartments 75. The at least one set of dividers 70 comprise a first rib 65 positioned against a first side wall 30 adjacent to a second rib 65 extending across the bottom panel 25 which is adjacent to a third rib 65 positioned against a second side wall 30 and opposite the first side wall, thereby defining at least two separate product receiving compartments 75, as illustrated in FIGS. 1-3. The insert 20 is of such a length that when folded and placed into the display box 15, the at least one set of dividers 70 has a height that is less than the height of the pair of side walls 30 and the front walls 45.

Removable insert 20 can easily fit into the product display box 15 to form display carton 10. The insert 20 may be associated with the side walls of the display box 15 in any suitable manner, for example, by frictional engagement with or by adhesively securing it to the pair of side walls 30.

Each of the product receiving compartments 75 will hold at least one product, such as a gift bag. By providing a limited quantity of products within each product receiving compartment, adequate support is provided for even a single gift bag that may remain in any one of the product receiving compartments.

In another specific embodiment of the insert as shown in FIGS. 7-12, single removable insert 20 comprises a foldable sheet 55 comprising three sections 56, 57, 58, each section having at least one rib 65. In specific embodiments, each of sections 56, 57, 58 may have two ribs 65.

Figure 7:
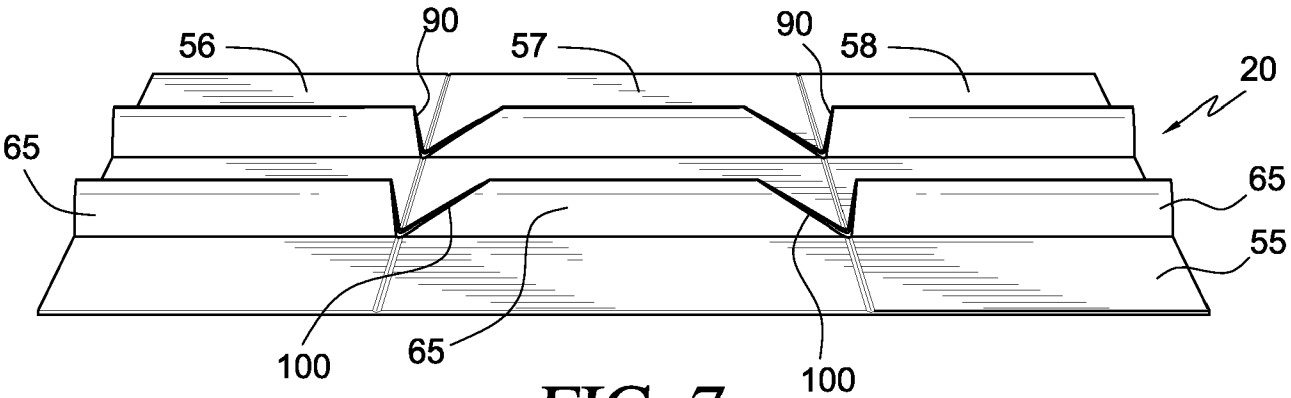
FIG. 7 is front perspective view of an insert according to second embodiment of the present invention.
Figure 8:
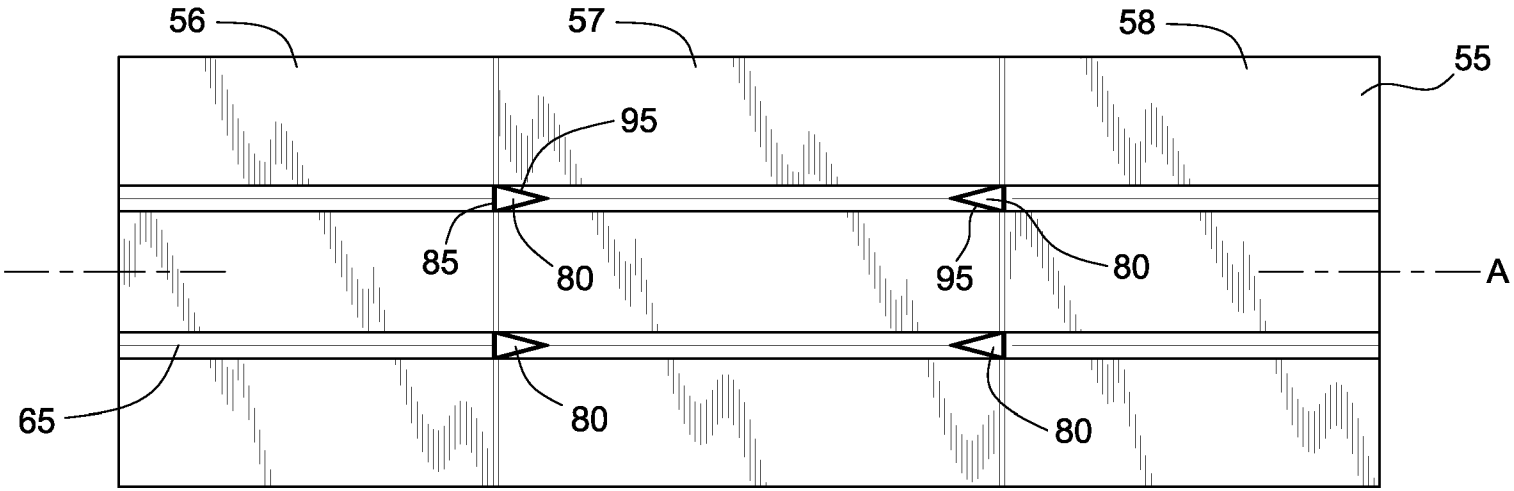
FIG. 8 is top view of the insert of FIG. 7.

As illustrated in FIG. 8, the foldable sheet 55 in its flat configuration comprises at least two triangular cutouts or holes 80, each cutout located at the junction of two sections, for example, between sections 56 and 57 and between sections 57 and 58. The triangular cutouts are identical, mirror images of each other. The triangular cutouts may be in any effective shape, for example, in the shape of an equilateral or isosceles triangle. In specific embodiments, the at least one rib 65 of each section is formed from pre-scored, pre-stressed, or pre-folded lines so that when the flat foldable sheet is folded in a direction transverse to longitudinal axis A, the at least one rib 65 on each section 56, 57, 58 forms as shown in FIG. 7.

As the sheet 55 is folded to make the at least one rib 65 on each section 56, 57, and 58, a bottom side 85 of each triangular cutout results in at least one rib having an end 90 with a right angle to the surface of the sheet (i.e., rib 65 on section 56 and rib 65 on section 58). The two sides 95 extending from the bottom side 85 of each triangular cutout to the apex results in at least one rib having angled ends 100, for example, ends having an acute angle of about 45° from a horizontal surface of the foldable sheet 55 (i.e., rib 65 on section 57). The folded sheet 55 comprises at least one rib 65 having an end with a right angle on section 56; at least one rib 65 having two angled ends on section 57, and at least one rib 65 having an end with a right angle on section 58, as shown in FIG. 7.

Figure 10:
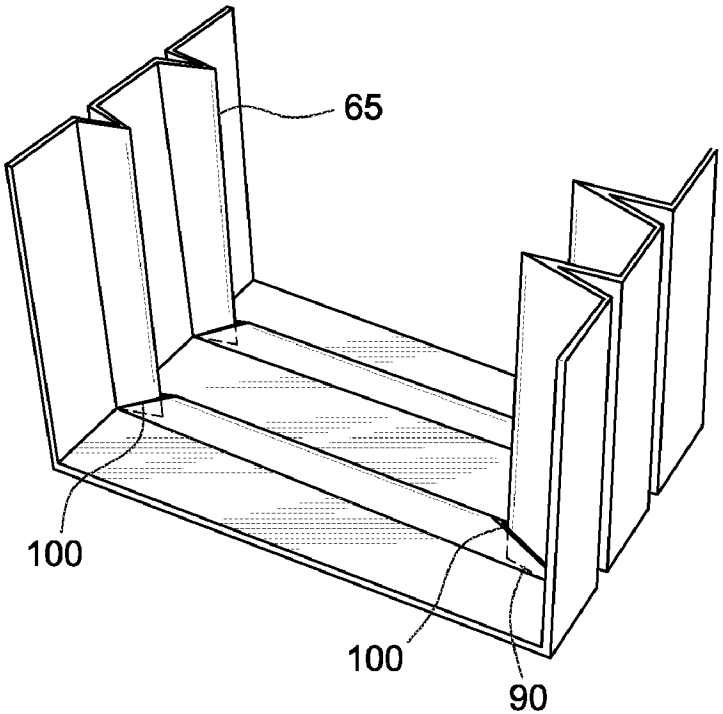
FIG. 10 illustrates a perspective view of FIG. 9.
Figure 9:
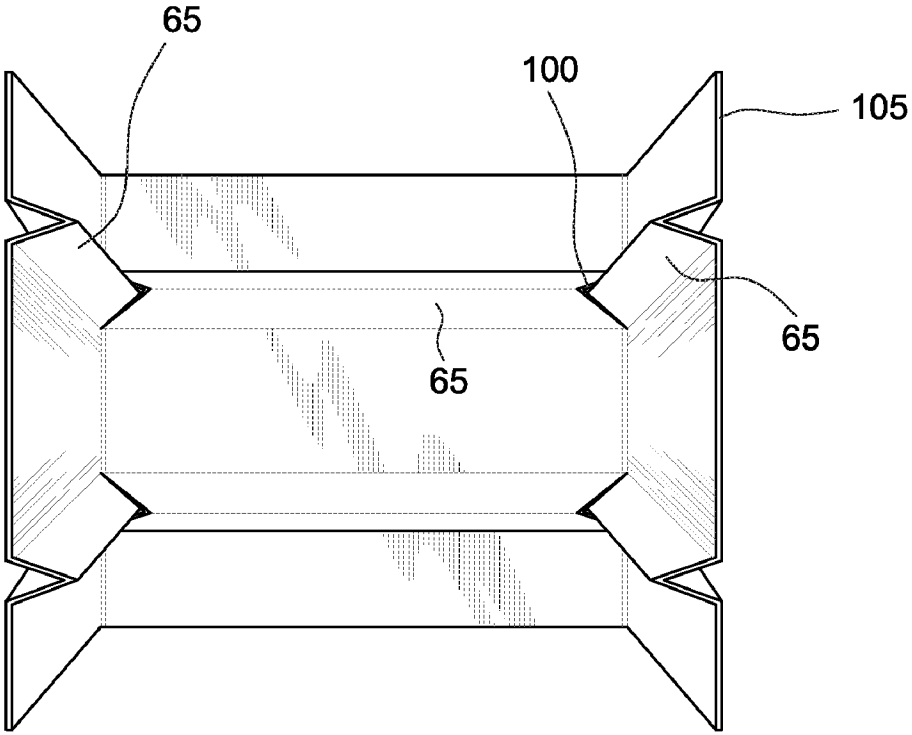
FIG. 9 illustrates a top view of the insert of FIG. 7 folded into a U-shape.
Figure 12:
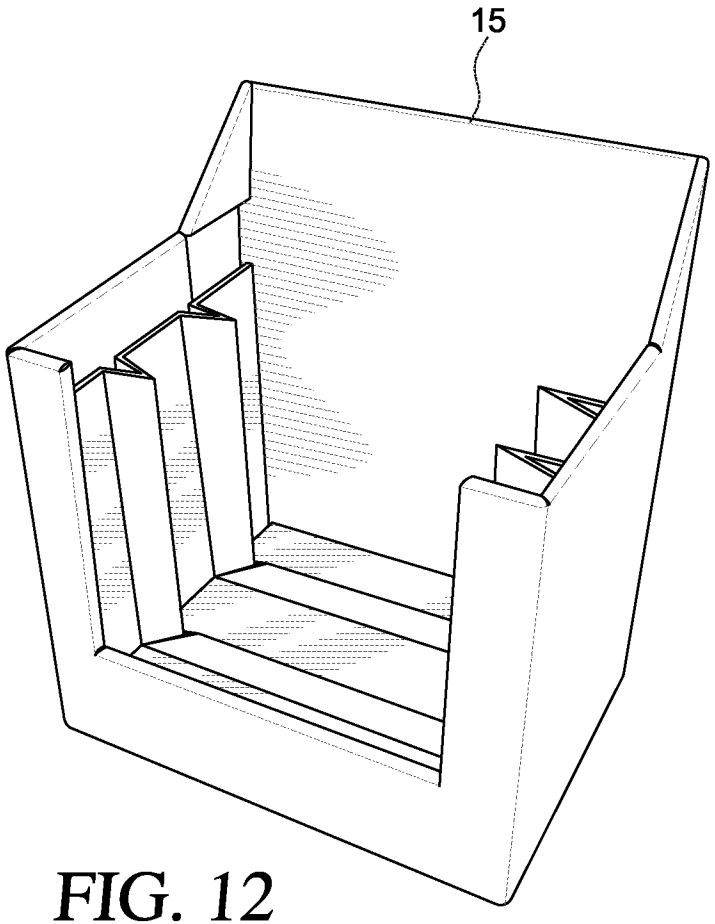
FIG. 12 illustrates a perspective view of the display carton of FIG. 11.
Figure 11:
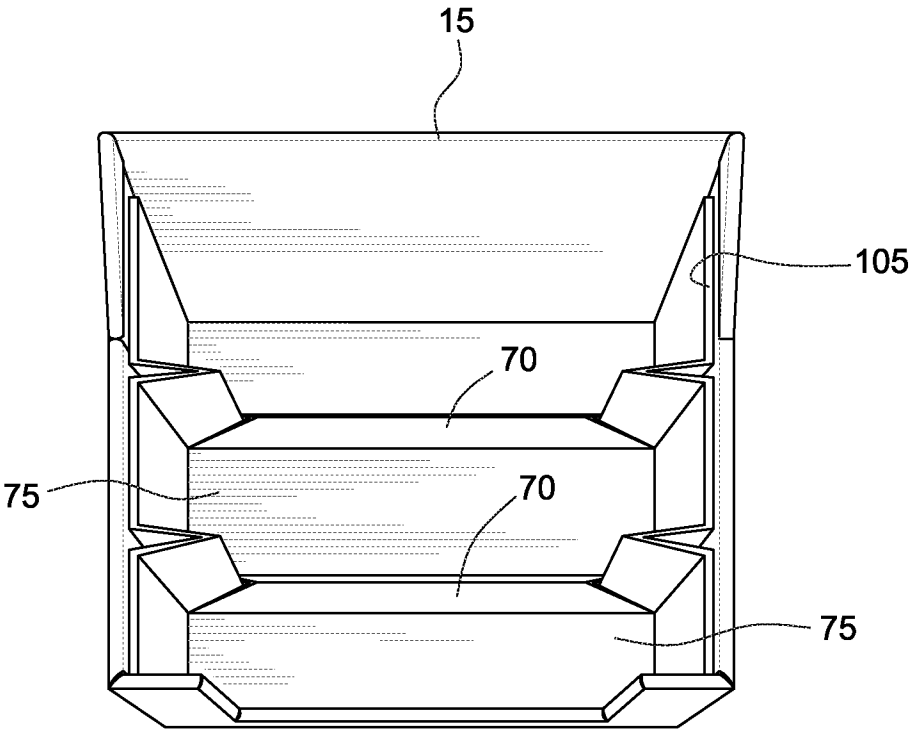
FIG. 11 illustrates a top view of a display carton with the insert of FIG. 7.

As illustrated in FIGS. 9-10, the at least one rib 65 having angled ends 100 is configured so that each end forms a gap for receiving the right angle end 90 of an adjacent rib when the foldable sheet is folded into a U-shaped insert 105 for a display box. Thus, when the foldable sheet 55 is folded into a U-shaped insert, the gap formed by angled ends 100 of the at least one rib 65 on section 57 receives the right angle end 90 of the at least one rib 65 on an adjacent section 56 or 58, respectively, thereby forming a reinforced joint. The U-shaped insert may be placed in a display box 15 as illustrated in FIGS. 11-12, thereby forming the at least one set of dividers 70 and at least two product receiving compartments 75 as discussed above.

According to a method of the present invention, the display carton may be made by folding a single sheet having three sections, each section comprising at least one rib into a U-shaped insert. The U-shaped insert is then placed into a display box having an open top. The display box includes a bottom panel, a rear wall extending upwardly from the bottom panel, a pair of side walls extending upwardly from the bottom panel, and a pair of front walls extending inwardly from the side walls. The pair of front walls is attached to a bottom front wall extending upwardly from the bottom panel.

In another specific embodiment of the insert as shown in FIGS. 13-19, single removable insert 105 comprises a foldable sheet 110 comprising three sections 115, 120, 125, each section having at least one hinged flap 130. In specific embodiments, each of sections 115, 120, 125 may have two hinged flaps 130.

In embodiments, the at least one hinged flap 130 of each section may be formed from pre-scored, pre-stressed, pre-folded, perforated, tear, or frangible lines of the foldable sheet 110, thereby forming cutouts or holes when pushed, punched, or pulled from the foldable sheet. The at least one hinged flap is partially detachable from the foldable sheet.

Figure 14:
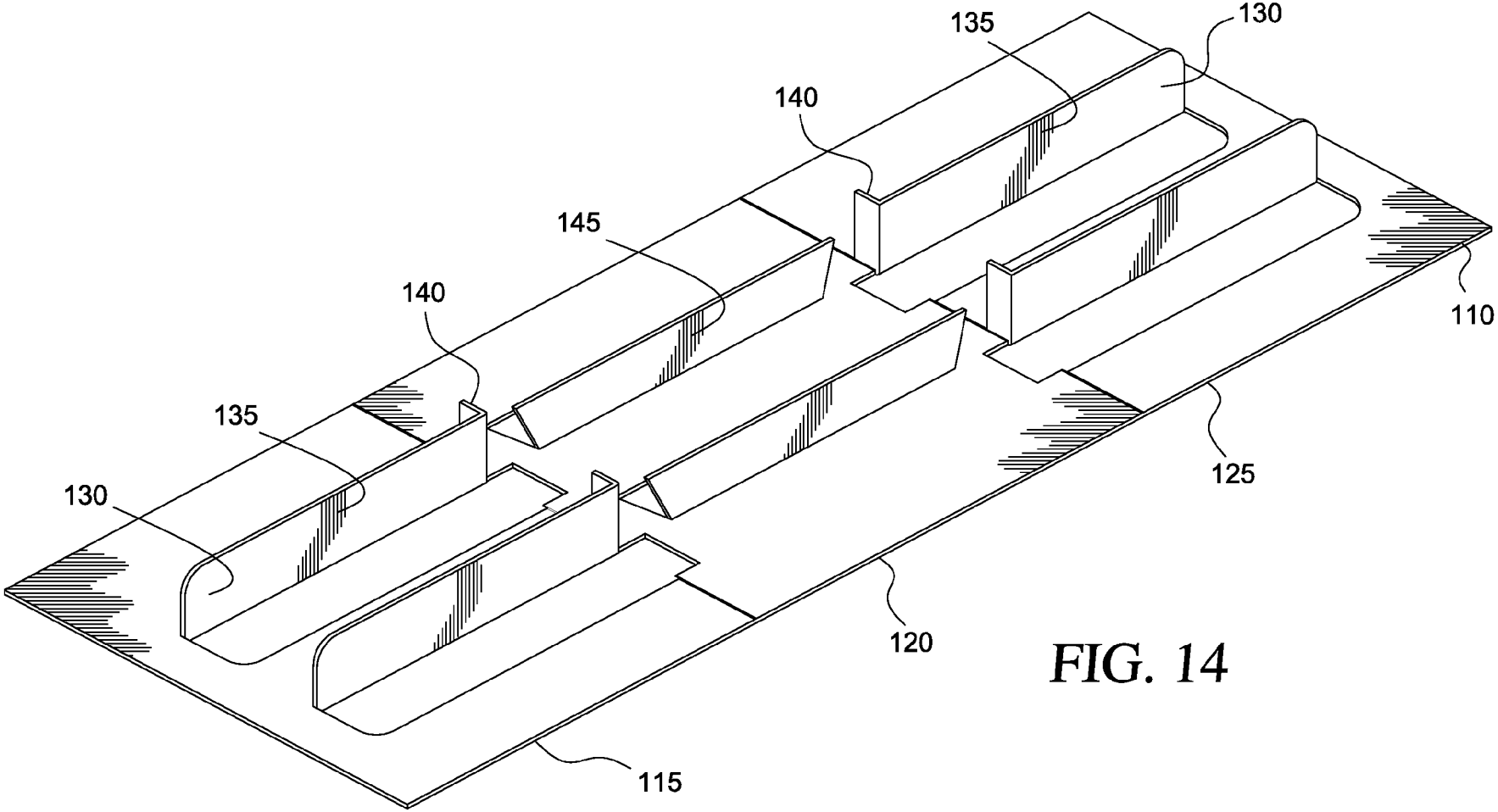
FIG. 14 is perspective view of the insert of FIG. 13.
Figure 16:
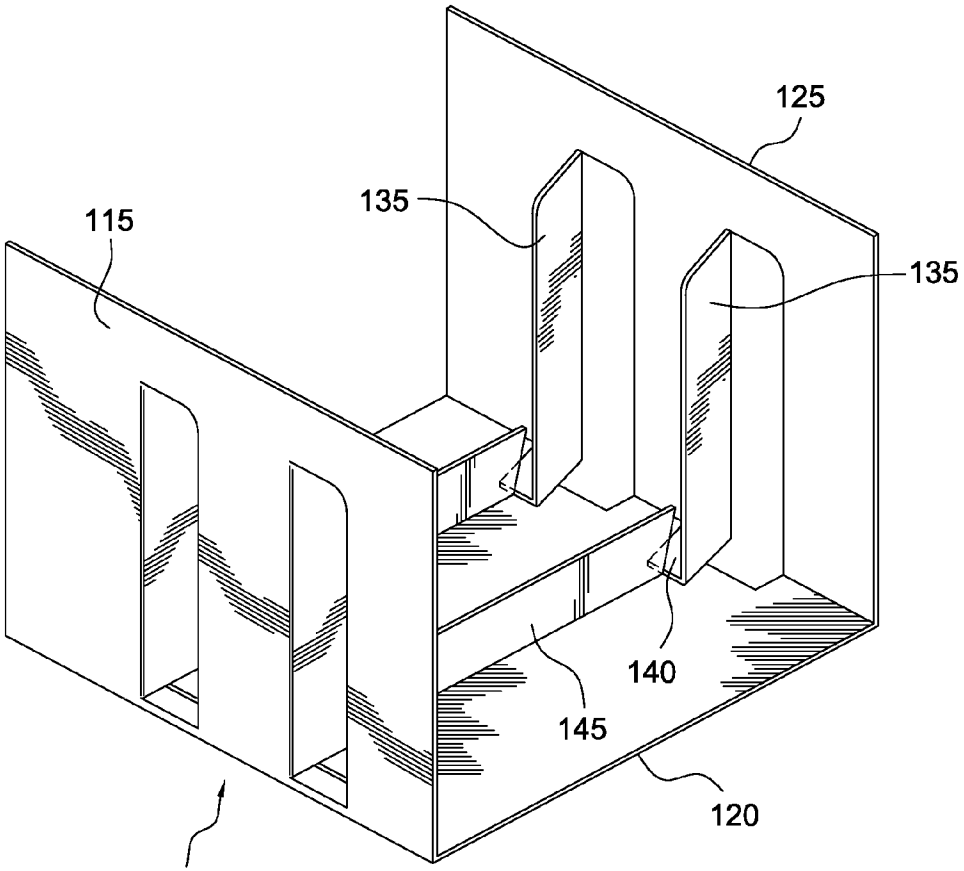
FIG. 16 illustrates a perspective view of FIG. 15.
Figure 15:
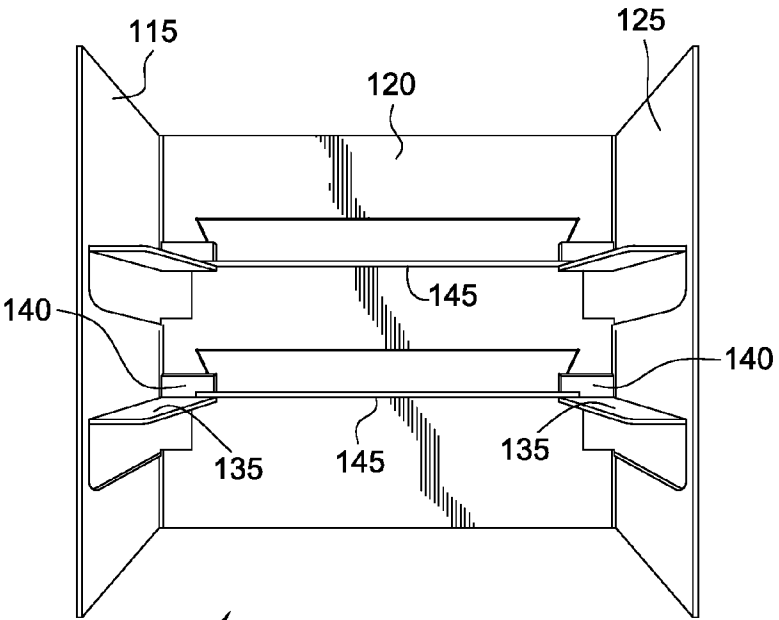
FIG. 15 illustrates a top view of the insert of FIG. 13 folded into a U-shape.

As shown in FIGS. 14-16, the at least one hinged flap 130 on each of end sections 115, 125 may have a rectangular-shaped section 135 and a footer 140. The footer 140 may be an angle, for example about a 90° angle, from a bottom of the rectangular-shaped section 135. One side of the rectangular-shaped section 135 is integral with and remains hingedly connected to the foldable sheet 110. When the at least one hinged flap 130 is pushed, punched, or pulled from the foldable sheet, it forms a corresponding rectangular-shaped cutout on each of sections 115, 125 with a footer cutout on the middle section 120. The at least one hinged flap 130 in sections 115, 125 are mirror images of one another. Although the at least one hinged flap on sections 115, 125 is shown as having a rectangular-shaped section, it may be of any effective shape.

As also shown in FIGS. 14-16, the at least one hinged flap 130 on middle section 120 may have a trapezoid-shaped section 145 having two opposing sides and two angled ends. One side of the trapezoid-shaped section 145 is integral with and remains hingedly connected to the foldable sheet 110. When the at least one hinged flap 130 is pushed, punched, or pulled from the foldable sheet, it forms a corresponding trapezoid-shaped cutout on middle section 120. Although the at least one hinged flap on middle section 120 is shown as having a trapezoid-shaped section, it may be of any effective shape.

The foldable sheet 110 may be used as an insert 105 in a product carton display. The foldable sheet 110 is folded into a U-shaped insert for a display box, as shown illustrated in FIGS. 15-16. As the foldable sheet is folded, the footers 140 on the at least one hinged flap 130 on each of sections 115, 125 may abut the corresponding angled ends of the trapezoid-shaped section 145 of the at least one hinged flap on the middle section 120. In one or more embodiments, the footers 140 may abut a bottom of the angled ends of the trapezoid-shaped section 145, either at an angle (e.g., a middle of a side or a front of the footer rests against an angled end of the trapezoid-shaped section) or so that each end of the trapezoid-shaped section rests against a corresponding rectangular-shaped section of hinged flaps in sections 115, 125.

Figure 18:
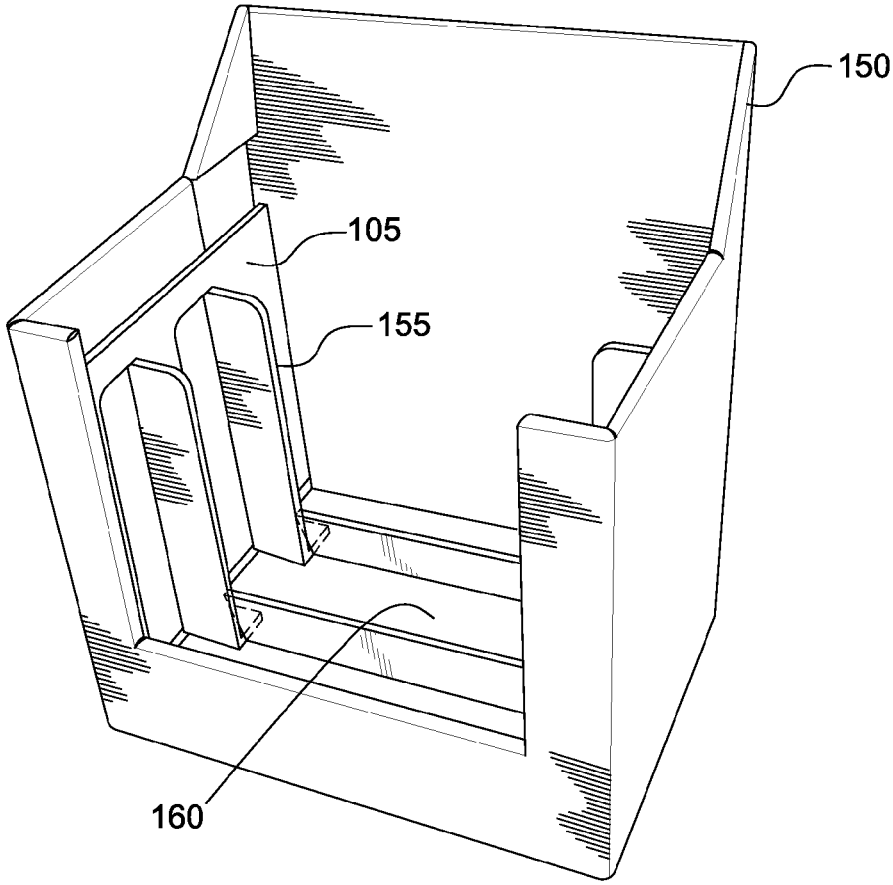
FIG. 18 illustrates a perspective view of the display carton of FIG. 17.
Figure 13:
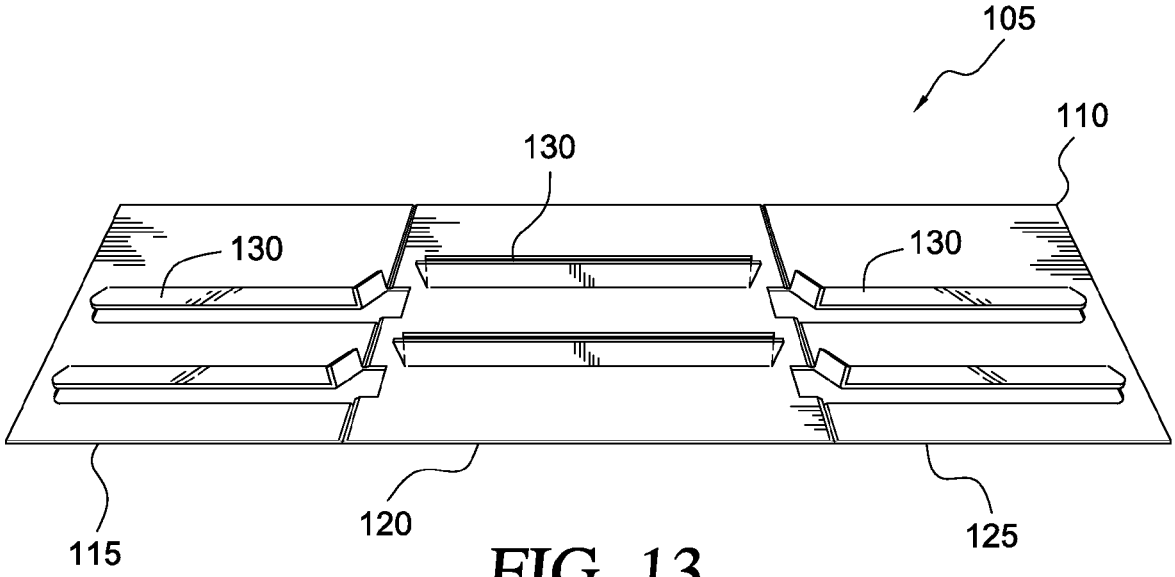
FIG. 13 is front view of an insert according to third embodiment of the present invention.
Figure 19:
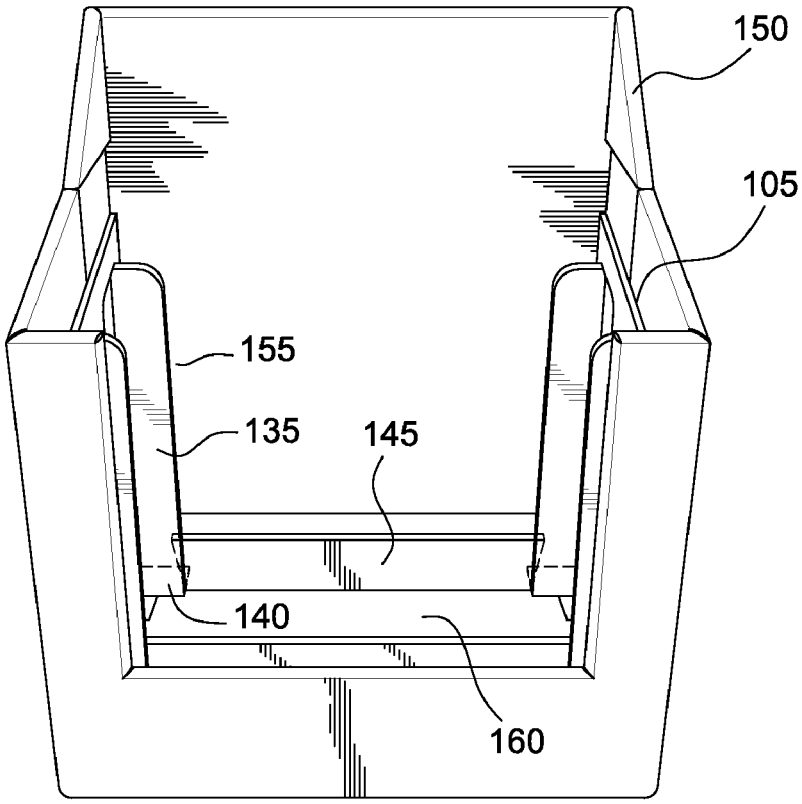
FIG. 19 illustrates a front view of the display carton of FIG. 17.
Figure 17:
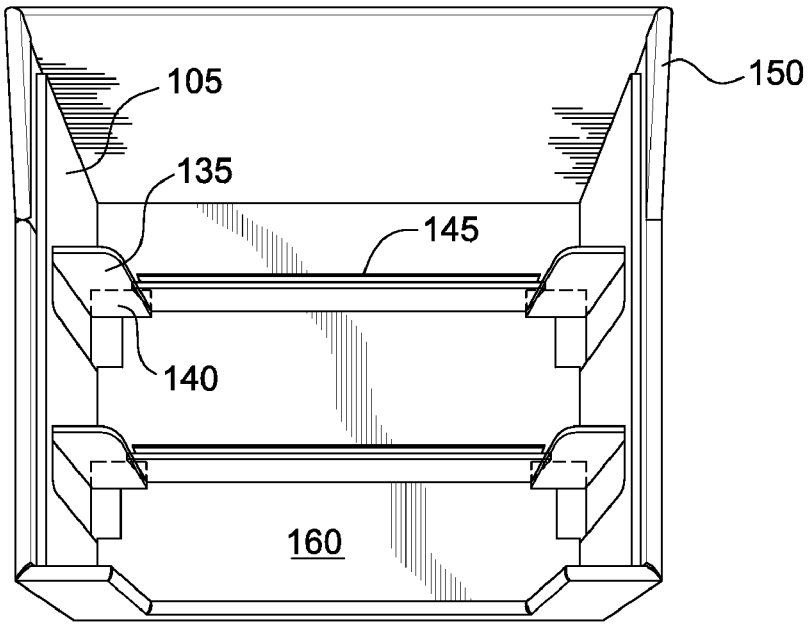
FIG. 17 illustrates a top view of a display carton with the insert of FIG. 13.

With reference to FIGS. 17-19, the U-shaped insert 105 may be placed into a product display carton 150, thereby forming the at least one set of dividers 155 comprising the hinged flaps 130 on each section and at least two product receiving compartments 160. The U-shaped insert may be placed into a display carton or box as shown and may also, in other embodiments, be rotated 180° and inserted in that configuration. The display carton may comprise a display box as described above, for example, with respect to FIGS. 1-4.

According to a method of the present invention, the display carton may be made by folding a single sheet having three sections, each section comprising at least one hinged flap into a U-shaped insert. The U-shaped insert is then placed into a display box having an open top. The display box includes a bottom panel, a rear wall extending upwardly from the bottom panel, a pair of side walls extending upwardly from the bottom panel, and a pair of front walls extending inwardly from the side walls. The pair of front walls is attached to a bottom front wall extending upwardly from the bottom panel.

Although specific embodiments of the invention have been described herein, it is understood by those skilled in the art that many other modifications and embodiments of the invention will come to mind to which the invention pertains, having benefit of the teaching presented in the foregoing description and associated drawings.

It is therefore understood that the invention is not limited to the specific embodiments disclosed herein, and that many modifications and other embodiments of the invention are intended to be included within the scope of the invention. Moreover, although specific terms are employed herein, they are used only in generic and descriptive sense, and not for the purposes of limiting the description invention.

What is claimed is:

1. A display carton, comprising:

a) a display box having an open top, comprising:

a bottom panel;

a rear wall extending upwardly from the bottom panel;

a pair of side walls extending upwardly from the bottom panel;

a pair of front walls, each front wall extending inwardly from a side wall and attached to a bottom front wall extending upwardly from the bottom panel, said pair of front walls and said bottom front wall forming a substantially unobstructed center viewing area for a displayed product; and b) a single insert comprising a foldable sheet comprising three sections, each section comprising at least one hinged flap, wherein the at least one hinged flap on each end section comprises a rectangular-shaped section and a footer, wherein the at least one hinged flap on a middle section comprises a trapezoid-shaped section, wherein the footer of the at least one hinged flap on each end section abuts a corresponding end of the trapezoid-shaped section of the at least one hinged flap on the middle section.

2. A product display carton according to claim 1, wherein the at least one hinged flap on each section comprises at least one of pre-scored, pre-stressed, pre-folded, perforated, tear, or frangible lines of the foldable sheet, thereby forming cutouts or holes when pushed, punched, or pulled from the foldable sheet.

3. A product display carton according to claim 1, wherein the footer is at an angle to a bottom of the rectangular section.

4. A product display carton according to claim 1, wherein the footer is at a 90° angle to a bottom of the rectangular section.

5. A product display carton according to claim 1, wherein the foldable sheet is folded into a U-shape with the middle section being a horizontal bottom and each end section extending upwardly from a respective end of the middle section.

6. A product display carton according to claim 1, wherein the at least one hinged flap on each end section extends inwardly from the side walls.

7. A product display carton according to claim 6, wherein the at least one hinged flap on each end section extends inwardly from the side walls at an acute angle from a vertical plane formed by the side walls.

8. A product display carton according to claim 1, wherein the at least one hinged flap on the middle section extends upwardly from the bottom panel.

9. A product display carton according to claim 8, wherein the at least one hinged flap on the middle section extends upwardly from the bottom panel at an acute angle from a horizontal plane formed by the bottom panel.

10. A product display carton according to claim 1, wherein the hinged flaps form at least one set of dividers for supporting the product.

11. A display carton according to claim 10, wherein said at least one set of dividers has a height that is less than the height of said pair of side walls and said pair of front walls.

12. A display carton according to claim 1, wherein said insert is integrally associated with said side walls of said display box by adhesively securing to said pair of side walls.

13. A display carton according to claim 1, wherein said displayed product comprises gift bags.

14. A display carton according to claim 1, wherein the display box and the insert both comprise a cardboard material.

15. A display carton according to claim 1, wherein the display box and the insert comprise no plastic, thermoplastic, or resin material.

16. A display carton, comprising:

a) a display box; and b) a single U-shaped insert comprising a foldable cardboard sheet having three sections, each section comprising at least one hinged flap, wherein the at least one hinged flap on the middle section comprises a trapezoid-shaped section, wherein the at least one hinged flap on each end section comprises a rectangular section and footer, said footer at a right angle to a bottom of the rectangular section and abutting an end of the trapezoid-shaped section.

17. A method of making the display carton of claim 1, comprising:

providing a display box having an open top, and comprising:

a bottom panel;

a rear wall extending upwardly from the bottom panel;

a pair of side walls extending upwardly from the bottom panel;

a pair of front walls, each front wall extending inwardly from a side wall and attached to a bottom front wall extending upwardly from the bottom panel, said pair of front walls and said bottom front wall forming a substantially unobstructed center viewing area for a displayed product;

folding an insert comprising a single cardboard sheet having 1) two end sections each comprising at least one hinged flap having a rectangular-shaped section and a footer, and 2) a middle section comprising at least one hinged flap having a trapezoid-shaped section, into a U-shape so that the footer of each end section abuts a corresponding angled end of the trapezoid-shaped section; and placing the U-shaped insert into a cardboard display box, wherein the hinged flaps on each section form at least one set of dividers for supporting a product.

* * * * *